United States Patent [19]

Valcho et al.

[11] Patent Number: 4,601,837

[45] Date of Patent: Jul. 22, 1986

[54] PROCESS FOR THE PREPARATION OF OVERBASED, MOLYBDENUM-ALKALINE EARTH METAL SULFONATE DISPERSIONS

[75] Inventors: Joseph J. Valcho; Steven E. Lindberg; Mack W. Hunt, all of Naperville, Ill.; Albert R. Sabol, Munster, Ind.

[73] Assignee: Amoco Corporation, Chicago, Ill.

[21] Appl. No.: 773,173

[22] Filed: Sep. 6, 1985

[51] Int. Cl.[4] ..... C10M 135/10; C10M 155/00

[52] U.S. Cl. ..... 252/40.7; 252/33; 252/400.54; 252/389 R; 252/400 R

[58] Field of Search ..... 252/33, 40.7, 389.54, 252/389.61, 400.54, 400.61

[56] References Cited

U.S. PATENT DOCUMENTS

| | | | |
|---|---|---|---|
| 3,496,105 | 2/1970 | Le Suer | 252/40.7 |
| 3,541,014 | 11/1970 | Le Suer | 252/40.7 |
| 4,137,186 | 1/1979 | Sabol | 252/33 |
| 4,225,446 | 9/1980 | Arnold et al. | 252/33.2 |

*Primary Examiner*—Jacqueline V. Howard
*Attorney, Agent, or Firm*—William C. Clarke; William T. McClain; William H. Magidson

[57] ABSTRACT

The process comprises in sequence the following steps: (a) introducing into a reaction zone a sulfonic acid comprising a neutral ammonium sulfonate; (b) adding to and mixing with said sulfonic acid a substantially inert diluent, an alkaline earth metal compound, water, and an alkanol to form a hydration mixture; (c) heating said hydration mixture at an elevated temperature to hydrate said alkaline earth metal compound; (d) adding a molybdenum-containing compound to said reaction zone at a time during the period beginning after the introduction of said sulfonic acid and extending through said refluxing of said hydration mixture; and (e) adding an acidic material to said reaction zone at a temperature within the range of about 26.7° C. (80° F.) to about 68.5° C. (155° F.) to form a molybdenum-alkaline earth metal sulfonate dispersion. In an embodiment of the process, the process is characterized further by stripping the alkanol from the reaction zone prior to adding the acidic material.

A polybutene succinic anhydride can be added to the reaction zone during the process as a process aid. Preferably, it is added prior to the addition of the molybdenum-containing compound.

34 Claims, No Drawings

PROCESS FOR THE PREPARATION OF OVERBASED, MOLYBDENUM-ALKALINE EARTH METAL SULFONATE DISPERSIONS

BACKGROUND OF THE INVENTION

This invention relates to a method for preparing overbased molybdenum-alkaline earth metal sulfonates. More particularly, this invention relates to a process for producing overbased molybdenum-alkaline earth metal sulfonates wherein a highly effective friction-reducing and anti-rust-providing composition is produced. The products of the process of this invention are highly overbased molybdenum-alkaline earth metal sulfonates having a TBN (total base number) greater than about 300 (metal ratio greater than about 15), which products provide a combination of highly valuable properties to lubricating oils including friction modification, anti-oxidation properties, and anti-rust properties.

In U.S. Pat. No. 4,137,186, Sabol discloses a process for preparing overbased magnesium sulfonate dispersions by hydrating a magnesium-containing compound at an elevated temperature in the presence of an inert diluent, an alkanol, an oil-soluble sulfonic acid compound containing from about 1 wt% to 100 wt% oil-soluble ammonium sulfonate, a stoichiometric excess of a hydratable magnesium compound based upon the sulfonic acid compound, water, a lower alkanol, and at least one substantially inert diluent, heating the composition to hydrate the magnesium compound, after the hydration is completed, heating the mixture to remove substantially all of the lower alkanol, and then adding an acidic material to the mixture at a temperature within the range of about 26.7° C. (80° F.) to about 68.3° C. (155° F.) to form an amorphous magnesium suspension.

In U.S. Pat. No. 3,496,105, LeSuer teaches a process for preparing molybdenum-containing alkaline earth metal sulfonates wherein an overbased carbonated alkaline earth metal sulfonate is contacted with an inorganic composition including ammonium and alkaline earth metal salts of molybdenum-containing anion such as $MoO_4$ and $Mo_7O_{24}$. These products, which are prepared directly from overbased carbonate materials, suffer the disadvantage that the molybdenum incorporated in the composition can form a solid precipitate or a hazy precipitate, rendering the molybdenum-containing sulfonate material useless for lubricating oils. While haze in the lubricating oil composition does not always reduce the lubricant properties, solid precipitate can cause plugging of channels in engines and mechanical damage.

Accordingly, a need exists to provide a process for the preparation of molybdenum-alkaline earth metal sulfonate dispersions which provide anti-wear, anti-rust, and anti-oxidation properties to lubricating oils and which do not form molybdenum precipitate during storage.

There has now been found and developed an improved process for producing highly basic molybdenum-alkaline earth metal overbased sulfonates by an economical, efficient productive process resulting in substantial incorporation of the molybdenum into the sulfonate which, when added to a lubricating oil, provides substantial anti-rust, anti-oxidation, and anti-wear properties to the oil and reduces the coefficient of friction of the oil.

SUMMARY OF THE INVENTION

The present invention is a process for the manufacture of an overbased molybdenum-alkaline earth metal sulfonate. The process comprises: (a) introducing into a reaction zone a sulfonic acid, at least about 0.1 wt% of which is neutralized with ammonia; (b) adding to said reaction zone a substantially inert diluent, an alkaline earth metal compound, an alkanol having from one to seven carbon atoms, and water to form a hydration mixture; (c) heating said hydration mixture at an elevated temperature to hydrate said alkaline earth metal compound to produce an alkaline earth metal hydroxide hydrate; (d) adding an acidic material to said reaction zone at a temperature within the range of about 26.7° C. (80° F.) to about 68.3° C. (155° F.); and (e) adding a molybdenum-containing compound to said reaction zone at a time in said process that is subsequent to said introducing of a sulfonic acid and prior to said adding of an acidic material to form said molybdenum-alkaline earth metal sulfonate. Magnesium oxide and calcium oxide are preferred alkaline earth metal compounds. In an embodiment of the process of the present invention, the process is characterized further by stripping said alkanol from said reaction zone to provide a substantially alkanol-free composition prior to adding an acidic material to said reaction zone. Molybdenum trioxide is a preferred molybdenum-containing compound. Methanol is a preferred alkanol. Oil-soluble petroleum sulfonic acids having molecular weights within the range of about 350 to 1,200 are suitable sulfonic acids.

A polybutene succinic anhydride can be added conveniently to the reaction zone as a process aid. Such material increases the efficiency of molybdenum incorporation and improves product clarity. Preferably, it is added prior to the addition of the molybdenum-containing compound.

The overbased molybdenum-alkaline earth metal sulfonate produced by this process is a suitable lubricating oil additive and provides substantial anti-rust, anti-oxidation, and anti-wear properties to the oil to which it is added.

DESCRIPTION AND PREFERRED EMBODIMENTS

Lubricating oil compositions that are suitable for use in diesel and other internal combustion engines are the heavy-duty, detergent-type lubricating oil compositions and must have appropriate lubricity and stability. In addition, if a high degree of engine cleanliness is to be maintained, they must disperse insolubles that are formed by fuel combustion and/or oil oxidation and must neutralize both the acidic combustion products and acidic lacquer precursors, thus providing rust inhibition.

Lubricating oil compositions used in marine diesel engines must have a high degree of reserve basicity, since marine engine fuels have a high sulfur content. Such high sulfur content results in a larger amount of acidic combustion products. While it is possible to alleviate this problem through the use of lower sulfur fuels, the economics of the situation make it desirable to use a high sulfur level in conjunction with a lubricating composition capable of neutralizing the acidic combustion products.

The term "overbasing" refers to increasing the basicity of a detergent additive agent. The attainment of an oil-soluble carbonate, or other salt, of an alkaline earth metal in the form of extremely small particles in a finely dispersed form is a highly desirable object of overbasing.

The overbasing of magnesium is quite difficult. It is desirable to provide an overbasing process that is capable of producing relatively low-cost overbased magnesium detergents. However, great difficulty has been encountered in utilizing inorganic basic magnesium compounds to an acceptable extent. In the past, discouraging results were obtained when magnesium compounds were used. Apparently, the magnesium compounds and the sulfonic acid compounds did not react sufficiently during neutralization and overbasing. The dispersions were sometimes unstable, hazy, and formed gels, and/or did not yield reproducible high TBN, preferably above 300 (metal ratios above 15). In addition, many commercially available sulfonic acids made from soft detergent alkylate bottoms were found to be resistant to overbasing.

While the overbasing of magnesium has been difficult, it has been accomplished, e.g., as disclosed by Sabol in U.S. Pat. No. 4,137,186, which is incorporated herein by reference and made a part hereof.

Moreover, it has now been found that molybdenum can be incorporated satisfactorily into an overbased alkaline earth metal sulfonate during its preparation, even when the alkaline earth metal is magnesium, and that the resulting molybdenum-alkaline earth metal sulfonate can be used as a friction-reducing agent in a lubricating oil composition.

For the purpose of the present invention, the amount of overbasing produced is reported as the Total Base Number (TBN), which is the number of milligrams of potassium hydroxide equivalent to the amount of acid required to neutralize the alkaline constituents present in 1 gram of the molybdenum-alkaline earth metal sulfonate. A standard procedure for measuring Total Base Number is ASTM D-2896. The metal ratio is the ratio of mole equivalents of metal in the composition to mole equivalents of organic acid in the composition.

It has been found that molybdenum can be added successfully to an overbased alkaline earth metal sulfonate composition during the preparation of that alkaline earth metal sulfonate composition. Moreover, it has been found surprisingly that the resulting overbased molybdenum-alkaline earth metal sulfonates are gel-free, haze-free, precipitate-free, have reproducible TBNs, even when using hard-to-treat sulfonic acids, and provide friction-reducing properties to lubricating oils to which they have been added.

According to the present invention, there is provided a process for the manufacture of an overbased molybdenum-alkaline earth metal sulfonate, which process comprises: (a) introducing into a reaction zone a sulfonic acid, at least about 0.1 wt% of which is neutralized with ammonium; (b) adding to said reaction zone a substantially inert diluent, an alkaline earth metal compound, an alkanol having from one to seven carbon atoms, and water to form a hydration mixture; (c) heating said hydration mixture at an elevated temperature to hydrate said alkaline earth metal compound to produce an alkaline earth metal hydroxide hydrate; (d) adding an acidic material to said reaction zone at a temperature within the range of about 26.7° C. (80° F.) to about 68.3° C. (155° F.); and (e) adding a molybdenum-containing compound to said reaction zone at a time in said process that is subsequent to said introducing of a sulfonic acid and prior to said adding of an acidic material to form said molybdenum-alkaline earth metal sulfonate. In one embodiment, the process comprises: (a) introducing into a reaction zone a sulfonic acid, at least about 0.1 wt% of which is neutralized with ammonia; (b) adding to said reaction zone a substantially inert diluent, an alkaline earth metal compound, an alkanol having from one to seven carbon atoms, and water to form a hydration mixture; (c) heating said hydration mixture at an elevated temperature to hydrate said alkaline earth metal compound to produce an alkaline earth metal hydroxide hydrate; (d) stripping said alkanol from said reaction zone to provide a substantially alkanol-free composition; (e) adding an acidic material to said reaction zone at a temperature within the range of about 26.7° C. (80° F.) to about 68.3° C. (155° F.); and (f) adding a molybdenum-containing compound to said reaction zone at a time in said process that is subsequent to said introducing of a sulfonic acid and prior to said adding of an acidic material to form said molybdenum-alkaline earth metal sulfonate. Magnesium oxide and calcium oxide are preferred alkaline earth metal compounds.

Generally, the diluent and alkaline earth metal compound are added to the reaction zone prior to the alkanol and water. For some metals, such as calcium, stripping alkanol prior to addition of acidic material is unnecessary.

Accordingly, the molybdenum-containing compound can be added at a time that is subsequent to the addition of the sulfonic acid, partially neutralized to ammonium sulfonate, prior to the addition of an acidic material. For example, it can be added directly to the ammonium sulfate, prior to the addition of the substantially inert diluent (solvent) and the alkaline earth metal compound. It can be added after the water and alkanol have been added to the mixture of sulfonate and alkaline earth metal compound and the resulting hydration mixture has been refluxed, or it can be added after the alkanol has been removed, but prior to the addition of the acidic material. A preferred method comprises adding the molybdenum-containing compound to the contents in the reaction zone after water and the alkanol have been added to the mixture of sulfonic acid, at least partially neutralized to ammonium sulfonate, and alkaline earth metal compound and the resulting hydration mixture has been heated at an elevated temperature. While the molybdenum can be added as a solid or as an aqueous solution, the addition of the molybdenum compound as an aqueous solution is preferred.

In a typical preparation, a mixture of ammonium sulfonate in xylene is refluxed with a mixture of an alkaline earth metal compound, an alkanol, and water for one hour, a solution of ammonium molybdate in water is added over a period of 10 to 15 minutes, and the resulting mixture is refluxed for 1 hour; the alkanol is stripped from the resulting mixture, the water content is adjusted, and the alkaline earth metal sulfonate/alkaline earth metal hydroxide is treated with the acidic material. A product having a high TBN, preferably a TBN of at least 300, is recovered after removal of water, filtration or centrifugation, and stripping.

Sulfonic acids and the ammonium salts thereof which can be used to prepare the lubricating oil additives of this invention are oil-soluble sulfonic acids, including petroleum sulfonic acids, commonly referred to as mahogany acids, alkyl sulfonic acids, aryl sulfonic acids, alkenyl sulfonic acids and alkyl aryl sulfonic acids. Illustrative of suitable sulfonic acids are the oil-soluble petroleum sulfonic acids having a molecular weight of about 350 to 1,200, dilauryl aryl sulfonic acid, lauryl cetyl sulfonic acid, paraffin wax, substituted benzene sulfonic acid, didodecyl benzene sulfonic acid, polyolefin alkylated benzene sulfonic acids, such as polypropene alkylated benzene sulfonic acids in which the polypropene substituent has a molecular weight from about 200 to about 5,000, preferably in the range of 300 to 1,200, naphthalene sulfonic acids, and alkyl substituted naphthalene sulfonic acids.

Neutral ammonium sulfonates can be obtained by blowing ammonia gas through the sulfonic acid or by adding ammonia hydroxide to the sulfonic acid and stripping water. Sulfonic acid can be held at room or elevated temperature or in the hydrocarbon solvent or neat during ammonium neutralization. Ammonium sulfonate added to the hydration mass provides a source of ammonium ions which aid in promoting the reactivity of both the molybdenum compounds and the alkaline earth metal compositions. The ammonia appears to promote hydration and suspension of both the molybdenum and alkaline earth metal compounds by attacking the basic atoms in the solid metal compounds, enhancing the reactivity of the metals, speeding hydration and suspension of the metals in the sulfonic acid. As little as 0.1 wt% of the oil-soluble sulfonic acid need be neutralized by ammonia to provide this catalytic effect. On the other hand, as much as 100 wt% of the oil-soluble sulfonic acid can be neutralized by ammonia.

Molybdenum compounds useful in the present invention are those which provide oxides or sulfides of molybdenum under reaction conditions. Such molybdenum compounds are ammonium molybdate, molybdenum oxides and sulfides, and the Group I and Group II salts of molybdic acid, for example, sodium molybdate, potassium molybdate, magnesium molybdate, calcium molybdate, and barium molybdate. Molybdenum trioxide is preferable in a variety of the reaction sequences for the reasons of ease of solubility in basic aqueous solution (preferably ammonium hydroxide or sodium hydroxide), reactivity with the sulfonic acid and availability. In addition, the various isopoly and heteropoly organic acid molybdenum anions are also suitable for use in these processes. The isopolymolybdates, such as paramolybdates, are illustrative of anions derived from isopolyacids while heteropolymolybdates illustrate heteropolyacid anions. These various anions are derived from acidic materials well known in the art and an extensive discussion of the preparation and characteristics can be found in standard chemical texts, for example, F. A. Cotton and D. Wilkinson, *Advanced Inorganic Chemistry*, pages 134–141, 185–188, 260–265, 394–403, 423–437, 779–790, etc., published by Interscience Publishers, New York, N.Y., 1962.

The substantially inert diluent that is employed in the process of the present invention can be mineral oil, aliphatic, cycloaliphatic, and aromatic hydrocarbons, such as xylene and toluene, 5W lube oil, and naphtha. In addition, volatile chlorinated hydrocarbons are suitable for use in the process. Preferably, mixtures of mineral oil and xylene, toluene or naphtha are used in the process. The boiling point of a xylene-mineral oil diluent is such that when the alkanol, such as methanol, present during hydration is stripped, the bulk of the xylene remains in solution. Xylene present in the diluent aids in process viscosity control. Ordinarily, the diluent is present in amounts within the range of about 20% to 80% by weight of the reaction mixture during hydration.

Alkaline earth metal compounds or Group IIA metal compounds that are suitable for use in the process of the present invention are compounds of magnesium, calcium, and barium. Compounds such as magnesium oxide, calcium oxide, barium oxide, magnesium hydroxide, calcium hydroxide, barium hydroxide, magnesium chloride, calcium nitrate, calcium alcoholates, magnesium alcoholates, and magnesium polyethoxyalcoholates can all be used to prepare the highly reactive compounds of this invention. However, magnesium oxide, calcium oxide, magnesium carbonate, calcium carbonate, magnesium hydroxide, and calcium hydroxide are preferred for reasons of availability, low cost, and ease of reaction with the sulfonic acid compound.

Lower alkanols that are suitable for use in the process of the present invention are the aliphatic alcohols having one to seven carbon atoms, such as methanol, ethanol, isopropanol, tertiary butanol, heptanol, isoheptanol, and the like.

Water is required in the reaction mixture of certain metal oxides during the hydration and the treatment with the acidic material, i.e., carbonation. Preferably, water reacts with the alkaline earth metal and molybdenum to produce amorphous alkaline earth metal molybdenum suspensions in the sulfonic acid.

Acidic materials that are suitable for use in the process of the present invention are inorganic acids, usually acidic gases or liquids, such as $H_3BO_3$, $CO_2$, $H_2S$, $SO_2$, HCl, $NO_2$, $PCl_3$, $ClO_2$, $BF_3$, $CS_2$, and COS. Lower aliphatic carboxylic acids can be used, e.g., formic, oxalic, acetic, and propionic acids. Formic acid is the preferred carboxylic acid. However, the inorganic acidic gases, particularly $CO_2$, $SO_2$ and $H_2$, are generally used. Carbon dioxide, which can be used to substantially overbase the alkaline earth metal-molybdenum compositions, is preferred due to overall considerations of cost, ease of use, availability, and performance of the overbased molybdenum-alkaline earth metal sulfonates.

Briefly, the process of the present invention is carried out by forming a composition of a sulfonic acid, of which at least about 0.1 mole % of the sulfonic acid is neutralized with ammonia, water, methanol, and an alkaline earth metal-yielding composition to form a hydration mass, contacting the hydration mass with a molybdenum-yielding composition, and hydrating a hydratable constituent of the hydration mass to form a hydrated mass, stripping the methanol from the hydrated mass, and contacting the stripped or unstripped hydrated mass with carbon dioxide until substantially all the alkaline earth is converted to carbonate.

In somewhat greater detail, a hydration mass is formed of a sulfonic acid, of which at least about 0.1 wt% can be neutralized by ammonia, water, a lower alkanol, and an alkaline earth metal compound. The hydration mass should contain about 1 to about 20 moles of alkaline earth metal compound per mole of sulfonic acid, enough water to substantially hydrate the alkaline earth metal compound which comprises about 1 to 5 moles of water per mole of alkaline earth metal compound, and a substantially hydration-promoting amount of lower alkanol which comprises from about 1 to about 8 moles of alkanol per mole of sulfonic acid. The molybdenum compound can be added to a hydration mass at this point; however, preferably, the hydration mass is refluxed to substantially hydrate the alkaline earth metal compound prior to addition to molybdenum. During the hydration, the hydrated alkaline earth metal compound displaces and liberates ammonia from the sulfonate hydration mass producing ammonia gas. The temperature of the reflux hydration step is not critical and is commonly done at reflux temperature. It has been discovered that the alkanol present in the reaction promotes the hydration of the alkaline earth metal compound, generally at a temperature within the range of about 60° C. (140° F.) to about 82° C. (180° F.).

At the conclusion of the hydration step, the molybdenum compound is preferably added to the hydrated mass in a ratio of about 0.1 to about 10 moles of molybdenum compound per mole of sulfonic acid. After the addition of the molybdenum compound, the mass can again be refluxed to promote the reaction of the molybdenum compound with the sulfonic acid hydrated composition. At the end of this optional reflux, methanol can be removed from the mass by stripping. It has been found that the alkanol can cause haze formation and gel formation, if present in the hydrated mass during the contact of the acidic material (carbon dioxide) with certain suspended metals such as magnesium. The alkanol can be conveniently stripped by heating the hydrated mass up to a temperature of about 171° C. (340° F.), optionally in the presence of additional amounts of water. We have found that alkanol bound in the hydrated mass can be displaced by the addition of water which displaces the alkanol from the hydrated mass. Substantially complete removal of alkanol (methanol) is necessary. A stripping of the alkanol, water addition, and a second stripping up to a temperature of about 138° C. (280° F.) may be required for substantially complete removal of the alkanol. During the stripping of the alkanol, some xylene, ammonia, and water may be removed. After the removal of the alkanol, the mixture is treated with an acidic material, preferably carbon dioxide, at a temperature of about 26.7° C. (80° F.) up to the decomposition temperature of the reaction mixture. Alkanol removal is unnecessary for metals such as calcium. It has been discovered that often in the presence of carbon dioxide an essentially crystalline monohydrated alkaline earth metal salt can be formed, if the carbonation temperature is excessive, depending on the amount of alkaline earth metal compound, molybdenum, and water. For best results, the carbonation is conducted at a temperature that is less than about 68.5° C. (155° F.). To insure complete carbonation of the mixture, the rate of carbon dioxide absorption is measured. About 2 moles to 3 moles of water per mole of an alkaline earth metal compound can be added during carbon dioxide addition. The water added during carbonation is added continuously during the carbonation or in 2 to 4 increments at regular intervals during the carbonation. Addition of all the water at the beginning of the carbonation can often produce a hazy product. The TBN and viscosity of the product, however, are not affected by small amounts of haze produced by the early addition of water. A small amount of haze produces merely a cosmetic defect. At the end of carbonation, solids can be removed from the mixture by, for example, centrifugation. The remaining solvents can be stripped by heating to a temperature within the range of about 171° C. (340° F.) to about 177° C. (350° F.) while blowing with nitrogen.

It has been found that a polybutene succinic anhydride can be used as a process aid in the process of the present invention. The addition of such a compound to the hydration mass increases the efficiency of molybdenum incorporation and improves the clarity of the product. Preferably, the polybutene succinic anhydride is added to the hydration mass prior to the incorporation of the molybdenum-containing compound. Polybutene succinic anhydrides having equivalent weights within the range of about 300 to 2,000 are suitable for use as process aids in the process. Polybutene succinic anhydrides having equivalent weights within the range of about 400 to about 1,000 are preferred. Typical examples of such process aids are a polybutene succinic anhydride having an equivalent weight of about 320 and a polybutene succinic anhydride having an equivalent weight of about 420. Conveniently, such polybutene succinic anhydride is added to provide an amount that is within the range of about 1 wt% to about 25 wt%, based on the weight of the hydration mass. Preferably, the polybutene succinic anhydride is added to provide an amount that is within the range of about 5 wt% to about 20 wt%, based on the weight of the hydration mass. It is contemplated that $C_{10}$ and higher carboxylic acids such as oleic acid or $C_{10}$ and higher alcohols could also be used as process aids.

The following examples provide embodiments of the process of this invention. They are presented for the purpose of illustration only and are not intended to limit the scope of either the claims or the present invention.

In the tests that are described hereinafter, the ammonium heptamolybdate, $(NH_4)_6Mo_7O_{24}.2H_2O$, was a commercial grade obtained either from Mallinckrodt, Inc., or J. T. Baker Co.; the ammonium molybdate, $(NH_4)_2MoO_4$, was obtained from Climax Molybdenum; the sodium molybdate, $Na_2MoO_4.2H_2O$, was obtained from Mallinckrodt, Inc. Selected Mid-Continent base stocks were obtained from Amoco Oil Company and Ashland Petroleum Company.

EXAMPLE I

In a three-neck, three-liter reaction flask, equipped with a reflux condenser, dropping funnel, heater, and stirrer, was charged a mixture of 152 grams of 47 wt% active ammonium sulfonate, 250 milliliters of xylene, and 40 grams of magnesium oxide. The mixture was heated and stirred, and 25 milliliters of methanol and 25 milliliters of water were added to the reaction mixture. The composition was raised to the reflux temperature of the mixture and 7.8 grams of ammonium molybdate (54 wt% molybdenum) dissolved in 10 grams of hot water were added to the mixture over a 10-minute period. At the end of the addition, the mixture was refluxed for an additional half hour. The composition was heated and methanol was removed at a temperature up to 93.3° C. (200° F.). At this time, 15 milliliters of water were added and the mixture was contacted with carbon dioxide for 60 minutes at a rate of 1.5 cubic feet of carbon dioxide per hour. Water was stripped and the reaction mixture, containing less than 2% solids, was filtered. The product, which was slightly hazy, had a TBN of 426 and contained about 1.8 wt% molybdenum.

The product was used as an additive (0.81% sulfonate) in 10W-40 oil containing 1.5 wt% zinc dialkyldithiophosphate, obtained from Amoco Chemicals Company, and Paratone 715 VI improver, obtained from Exxon Chemical Americas, which oil was subjected to a Falex No. 6 4-ball test. The average coefficient of friction was found to be 0.05 with a wear scar diameter of 0.41 mm (0.5 inch balls, 250° F., 1,500 rpm, 5 minutes each at 10 kg, 20 kg, and 30 kg, and 15 minutes at 40 kg).

EXAMPLE II

Example I was repeated, except that 15.6 grams of ammonium molybdate were added in place of the 7.8 grams, 304 grams of ammonium sulfonate were used in place of the 152 grams, and 20 grams of a solvent-extracted 100 neutral base oil, obtained from Amoco Oil Company, were added as a diluent. The composition had a TBN of 374 and a molybdenum content of 1.47 wt%.

The product of this preparation was employed as an additive in the 10W-40 oil mentioned in Example I hereinabove. At a 0.92% sulfonate concentration, the oil was subjected to a Falex No. 6 4-ball test. The coefficients of friction were 0.062, 0.054, 0.043, and 0.082 at 10, 20, 30, and 40 kg loads on the 4-ball test (average coefficient of friction=0.060). The product contained 1.5% solids prior to finishing.

EXAMPLE III

Example I was repeated, except that an ammonium molybdate solution prepared by the addition of 13.4 grams of molybdenum trioxide to 20 grams of 29 wt% ammonium hydroxide was used in place of the 7.8 grams of ammonium molybdate. In addition, 350 milliliters of xylene and 1 gram of calcium oxide were used. The mixture contained 3% solids prior to finishing. The product had a TBN of 356 and contained 2.85% molybdenum. The average coefficient of friction was 0.041 with a 0.36 mm wear scar diameter, when the product was used in a 10W-40 oil obtained from Amoco Oil Company to provide 0.028 wt% molybdenum.

EXAMPLE IV

Into a three-liter, three-neck reaction flask equipped with a reflux condenser, stirrer, heater, and thermometer were charged 152 grams of 47 wt% active ammonium sulfonate, 250 milliliters of xylene, and 40 grams of magnesium oxide. The mixture was stirred and heated to reflux and 25 milliliters of methanol and 25 milliliters of water were added. To the refluxed mass were added 11.2 grams (4.44 grams molybdenum) of sodium molybdate dihydrate ($Na_2MoO_4.2H_2O$) in 20 grams of hot water. After the addition, the mass was refluxed for 1.5 hours. Methanol was stripped at a temperature up to 93.3° C. (200° F.), and the mixture was carbonated for 60 minutes at 1.5 cubic feet of carbon dioxide per hour. Water was stripped from the product and the solution was filtered, resulting in a product having a TBN of 429 and 1.78 wt% molybdenum. At a concentration of 0.81% sulfonate in the 10W-40 formulation, the average coefficient of friction in the Falex No. 6 4-ball test was 0.047 with a wear scar diameter of 0.40 mm.

EXAMPLE V

Example I was repeated, except that 20.2 grams of sodium molybdate and 25 millimeters of hot water were substituted for the 7.8 grams of ammonium molybdate. The product had a TBN of 420 and contained 2.55 wt% molybdenum. The average coefficient of friction was found in a Falex No. 6 4-ball test to be 0.052.

EXAMPLE VI

To a three-liter, three-neck reaction flask equipped with a reflux condenser, heater, stirrer, and dropping funnel were charged 644 grams of 44.5 wt% active soap of ammonium polypropylbenzene sulfonate, 1,200 grams of xylene, 100 grams of polybutene succinic anhydride having an equivalent weight of 420, 160 grams of magnesium oxide, 100 milliliters of water, and 148 milliliters of methanol. The mixture was heated to reflux and stirred for one hour. A solution of 68 grams of ammonium molybdate [$(NH_4)_6Mo_7O_{24}.2H_2O$] in 110 grams of hot water was slowly added to the mixture over about a 10-minute period. At the end of the addition, the mixture was refluxed for 1.5 hours. At the end of the reflux, the solution was stripped of methanol, was contacted with carbon dioxide for about 60 minutes at a rate of 1.5 cubic feet of carbon dioxide per hour, was again stripped of volatile materials, filtered of particulates, and stripped. The product had a TBN of 348 and a molybdenum content of 3.48 wt%.

EXAMPLE VII

This example was carried out in the same manner as Example VI. However, 463 grams of the sulfonate, 54 grams of a polybutene succinic anhydride having an equivalent weight of about 320, 84 grams of magnesium oxide, and a solution of 50 grams of sodium molybdate in 60 milliliters of hot water were employed. The product had a TBN of 318, a molybdenum content of 3 wt% by X-ray fluorescence (100% of theoretical), and 1.7 wt% sodium by atomic adsorption (123% of theoretical). The product was slightly hazy.

EXAMPLE VIII

This example was carried out in the same manner as Example VI. However, 483 grams of ammonium sulfonate, 75 grams of polybutene succinic anhydride having an equivalent weight of about 420, 90 grams of magnesium oxide, and a solution of 46.5 grams of sodium molybdate in 60 grams of hot water were used. The resulting product exhibited a molybdenum content of 2.6 wt% by X-ray fluorescence (97% of theoretical) [2.5 wt% by wet chemical analysis].

EXAMPLE IX

This example was conducted in the same manner as Example VI, with the exception that 120 grams of ammonium sulfonate, 25 grams of the polybutene succinic anhydride, 40 grams of magnesium oxide, and a solution of 16.6 grams of sodium molybdate dihydrate, $Na_2MoO_4.2H_2O$, in 20 grams of hot water were employed. The product had a TBN of 399 and a molybdenum content of 2.2 wt% by X-ray fluorescence (78.5% of theoretical) and was slightly hazy.

EXAMPLE X

In this example, 463 grams of ammonium sulfonate, 75 grams of the polybutene succinic anhydride having an equivalent weight of about 420, and 90 grams of magnesium oxide were reacted as in Example VI hereinabove prior to the addition of a solution of 51 grams of ammonium heptamolybdate in 60 grams of hot water. The product had a TBN of 276 and a molybdenum content of 4.0 wt% by X-ray fluorescence (100% of theoretical) [3.9 wt% by wet chemical analysis]. The product was clear.

EXAMPLE XI

This example was carried out in the same manner as Example VI. However, 161 grams of ammonium sulfonate, 30 grams of magnesium oxide, and a solution of 17 grams of ammonium heptamolybdate in 20 grams of hot water were used. The resulting product had a TBN of 267 and a molybdenum content of 4.2 wt% by X-ray fluorescence (105% of theoretical) and was clear.

EXAMPLE XII

This example was conducted in the same manner as Example VI. However, 420 grams of ammonium sulfonate, 120 grams of magnesium oxide, 75 grams of the polybutene succinic anhydride, and a solution of 50 grams of sodium molybdate in 60 milliliters of hot water were employed. The product had a TBN of 353 and a molybdenum content of 2.6 wt% to 2.9 wt% by X-ray fluorescence (83% to 90% of theoretical).

EXAMPLE XIII

Two high base magnesium sulfonates were used as standards for comparative purposes. Sulfonate A was obtained from Witco Chemical Company. Sulfonate B was obtained from the Natchez, Miss., plant of Amoco Chemicals Company.

EXAMPLE XIV

Each of the products of Examples I, II, III, IV, and V, was subjected to the Falex No. 6 4-ball test. The average coefficient of friction ($\mu$) was obtained from the Falex No. 6 4-ball test for each of these products, as well as the above two comparative standard magnesium sulfonates. The $\mu$ was the average coefficient of friction at 22-, 44-, 66-, and 88-pound loads on the Falex No. 6 4-ball test at 121° C. (250° F.) and 1,500 rpm. In addition, the wear scar diameter (WSD) is provided for each. The results of these Falex No. 6 4-ball tests are presented hereinbelow in Table I.

TABLE I

| MOLYBDENUM INCORPORATION INTO MAGNESIUM SULFONATES | | | | | | |
|---|---|---|---|---|---|---|
| Example | Molybdate | TBN | XRF % Mo | % Mo Utilized | $\mu$ | WSD, mm |
| I | $(NH_4)_6Mo_7O_{24}$ | 426 | 1.82 | — | 0.050 | 0.41 |
| II | $(NH_4)_6Mo_7O_{24}$ | 374 | 1.47 | 70 | 0.060 | 0.42 |
| III | $(NH_4)_2MoO_4$ | 356 | 2.84 | 65 | 0.041 | 0.36 |
| IV | $Na_2MoO_4$ | 429 | 1.78[1] | 80 | 0.047 | 0.40 |
| V | $Na_2MoO_4$ | 402 | 2.55[2] | 64 | 0.052 | 0.59 |
| XIIIA | — | 385 | — | — | 0.073 | 0.54 |
| XIIIB | — | 420 | — | — | 0.073 | 0.44 |

[1]0.97 wt % sodium
[2]1.70 wt % sodium

The data in Table I demonstrate that the introduction of molybdenum into the sulfonate during the hydration process provides a beneficial effect by reducing substantially the coefficient of friction.

EXAMPLE XV

Moreover, the addition of the polybutene succinic anhydride to the overbased magnesium sulfonate provides a reduction in haze in the finished product. The percent incorporation of molybdenum into the finished product is also generally increased by the addition of polybutene succinic anhydride to the process. This is shown in Table II for the sodium-containing and non-sodium containing products.

TABLE II

| HAZE REDUCTION | | | | | |
|---|---|---|---|---|---|
| Product from Example | II | VI | X | | XI |
| TBN | 374 | 366 | 273 | | 267 |
| % PSA-1 | 0 | 15.5 | 15.5 | | N/A |
| % PSA-2 | N/A | N/A | N/A | | 10.0 |
| % Solids | 1.5 | 2.5 | 2.0 | | 2.0 |
| % Molybdenum | 1.5 | 3.5[1] | 4.0 | (3.9)[2] | 4.2 |
| % of Theoretical | 70 | 87 | 100 | | 105 |
| % Sodium | N/A | N/A | N/A | | N/A |
| Appearance | Very hazy | Hazy | Clear | | Clear |
| Product from Example | V | IX | VIII | | VII |
| TBN | 402 | 399 | 310 | | 318 |
| % PSA-1 | 0 | 17.9 | 15.5 | | N/A |
| % PSA-2 | N/A | N/A | N/A | | 11.0 |
| % Solids | 1.0 | 2.1 | 2.3 | | 2.5 |
| % Molybdenum | 2.6 | 2.2[3] | 2.6 | (2.5)[2] | 3.0 |
| % of Theoretical | 64 | 78 | 97 | | 100 |
| % Sodium | 1.7 | 1.3 | 1.4 | | 1.4 |
| Appearance | Very hazy | Hazy | Clear | | Slightly Hazy |

PSA-1 Polybutene succinic anhydride with an equivalent weight of about 420
PSA-2 Polybutene succinic anhydride with an equivalent weight of about 320
[1]4.4% molybdenum in solids
[2]By wet chemical analysis
[3]5.8% molybdenum in solids
N/A Not applicable

EXAMPLE XVI

The products from several of the above examples were tested at the bench for their antioxidant performances. An oxidative thickening test, proprietary to Amoco, identified hereinafter as "OTT", and a differential scanning colorimetry bench test, identified hereinafter as "DSC", were conducted. The following oil blend was used for either test and the product being tested, whether an overbased alkaline earth metal sulfonate or an overbased molybdenum-alkaline earth metal sulfonate, was introduced into the oil blend, which comprised a solvent-extracted 100 neutral base oil obtained from Amoco Oil Company, 0.86 wt% zinc dialkyldithiophosphate oxidation/wear inhibitor (0.07 wt% phosphorus) and 7.15 wt% polymeric viscosity index improver obtained from Exxon Chemical Americas, 0.40 wt% Acryloid-150 pour point depressant obtained from Rohm and Haas, 0.49 wt% high base sulfurized calcium phenate detergent, 0.375 wt% oxidation inhibitor from Amoco Chemicals Company and 3.65 wt% Mannich dispersant obtained from the Amoco Chemicals Company.

In the OTT, the oil sample being tested is mixed with an oxidation catalyst and the mixture is heated, while air is blown through it. Samples of the treated oil are taken and the viscosity increase measured. The smaller increase in viscosity represents improved oxidation resistance of the oil.

In DSC, a Dupont 990 Thermal Analyzer is employed. The oil being tested is heated at a controlled rate until exothermic oxidation is detected. The temperature at which this oxidation is initiated is the DSC onset temperature. The higher temperature indicates improved oxidation resistance of the oil.

The results of these oxidation-inhibition bench tests are presented hereinbelow in Table III. Also, the results of differential scanning colorimetry (DSC) bench tests are presented in Table III.

The oxidative thickening of an oil is catalyzed by engine sludge. However, the use of the molybdenum-containing sulfonates lessens the viscosity increase of motor oils. This is shown by the results presented in Table III. Both the molybdenum and sodium-molybdenum forms of the magnesium sulfonates greatly lessen the 40-hour viscosity increase provided by the non-molybdenum-containing sulfonate. As shown by the DSC bench tests, both the molybdenum and sodium-molybdenum forms of the magnesium sulfonates delayed the onset of exothermic oxidation.

TABLE III

ANTIOXIDANT EFFECT OF MOLYBDENUM IN OILS[1]

| Sample | Sulfonate A | Mo—Sulfonate VI | Mo—Sulfonate X | Mo—Sulfonate XI | $Na_2Mo$—Sulfonate VIII | $Na_2Mo$—Sulfonate VII |
|---|---|---|---|---|---|---|
| TBN | 385 | 366 | 273 | 267 | 310 | 287 |
| % Molybdenum | 0 | 3.5 | 4.0 | 4.0 | 2.6 | 3.5 |
| % Molybdenum in Blend | 0 | 0.033 | 0.051 | 0.052 | 0.029 | 0.042 |
| Wt. % Sulfonate | 0.90 | 0.95 | 1.27 | 1.30 | 1.11 | 1.21 |
| OTT, 171° C. (340° F.) | | | | | | |
| 40-Hr % Viscosity Increase | >4000 | 332 | 415 | 769 | 275 | 181 |
| DSC Onset Temp., °C. | 241.3 | 251.9 | 257.2 | 255.3 | 255.4 | — |
| DSC Onset Temp., °C.[2] | 239.8 | — | — | 254.8 | — | 252.8 |

[1]Formulated as described hereinabove
[2]Same formulation, without the sulfur-containing olefin

EXAMPLE XVII

The product from Example VII was tested for its ability to function as an oxidation inhibitor in the ASTM Sequence IIID Test. The results of this test are presented hereinbelow in Table IV. The oil contained 1.37 wt% of the product from Example VII and comprised 3.65 wt% Mannich dispersant of Amoco Chemicals Company, 1.35 wt% zinc dialkyldithiophosphate oxidation/wear inhibitor, and 0.48 wt% high-base sulfurized calcium phenate detergent obtained from Amoco Chemicals Company, 0.13 wt% solvent-extracted 100 neutral base oil obtained from Amoco Oil Company, 0.4 wt% Acryloid-150 pour point depressant obtained from Rohm and Haas, 7.15 wt% polymeric viscosity index improver obtained from Amoco Chemicals Company, and Mid-Continent stocks from Ashland Petroleum Company. This sample is identified hereinafter as Sample C. The non-molybdenum-containing Sulfonate A, obtained from the Witco Chemical Company, was used in a comparative sample, Sample D. Sample D was similar to Sample C, except that it contained 0.9 wt% Sulfonate A, instead of the product from Example VII.

TABLE IV

SODIUM-MOLYBDATE SULFONATE IN IIID ENGINE TEST

| Sample | C | D | |
|---|---|---|---|
| % Molybdenum | 0.04 | — | — |
| ppm Sodium | 190 | — | — |
| % Viscosity Increase (64 hr) | 372 | 938 | 964 |
| Avg. Sludge | 9.51 | 9.51 | 9.34 |
| Piston Varnish | 9.32 | 8.78 | 9.11 |
| Ring LFV(1) | 6.81 | 5.28 | 4.67 |
| Max. Wear, in. | 0.0050 | 0.0031 | 0.0025 |
| Avg. Wear, in. | 0.0022 | 0.0012 | 0.0016 |

(1)Ring LFV = Ring land face varnish

It is shown by Table IV that, in the absence of molybdenum, the viscosity of the oil increased by 938% and 964% in 64 hours. However, the molybdenum-containing sample provided only 372% increase in viscosity. The passing limit for the test is a 375% increase. The molybdenum-containing sample passed the test. It also passed on cleanliness and wear. A reading of 9.2 is needed for passing sludge and varnish (10=clean). The limit for the Ring LFV is 4.8. Sample C also passed the ASTM Sequence IID rust test with a value of 8.51. A value of 8.5 is passing. A value of 10 is clean.

The friction reduction abilities of the product of Example X, Sample E, and the product of Example XII, Sample F, were determined in motored engine tests. In addition, a non-molybdenum-containing sample was tested. This sample, Sample G, contained 0.9 wt% of a commercial magnesium sulfonate obtained from the Witco Chemical Company. Each sample in these friction-reduction tests comprised solvent-extracted Mid-Continent base oils, 10 wt% Paratone-715 viscosity improver obtained from Exxon Chemical Americas, 4.5 wt% Mannich dispersant obtained from Amoco Chemicals Company, 0.7 wt% high based sulfurized calcium phenate detergent obtained from Amoco Chemicals Company, 0.5 wt% Acryloid-150 pour point depressant obtained from Rohm and Haas, and 1.35 wt% zinc dialkyldithiophosphate obtained from Amoco Chemicals Company.

In a motored engine test, an electric motor is used to turn a 350 cubic inch Oldsmobile V-8 engine that is mounted on a test stand at 1,800 rpm. The resulting internal friction warms the oil to 149° C. (300° F.). The currents that are drawn by the electric motor at temperatures of 104° C. (220° F.), 127° C. (260° F.), 138° C. (280° F.), and 149° C. (300° F.) are measured and converted into horsepower, which is the power needed to turn the engine at 1,800 rpm. The difference between the non-molybdenum modified baseline oil, Sample G, and the molybdenum-containing oils, Sample E and Sample F, which is presented hereinbelow in Table V, is the friction horsepower benefit expressed as % reduction in required power, i.e., how much less horsepower is required to turn the engine at 1,800 rpm.

TABLE V

FRICTION-REDUCTION ABILITIES

| Temperature °C. | Temperature °F. | Horsepower for Sample G (0 Mo) | % Reduction in Required Power Sample E (0.04% Mo) | % Reduction in Required Power Sample F (0.04% Mo) |
|---|---|---|---|---|
| 104 | 220 | 9.45 | 5.0 | 6.7 |
| 127 | 260 | 9.85 | 7.9 | 10.5 |
| 138 | 280 | 10.30 | 7.6 | 11.2 |
| 149 | 300 | 10.70 | 4.6 | 9.1 |

As these results show, the samples containing the overbased molybdenum-magnesium sulfonates of the present invention provided reduced horsepower requirements at all temperatures studied.

EXAMPLE XIX

The product of Example II, Sample H, was run in dynamometer tests to demonstrate fuel economy. It was compared to a molybdenum-phosphorus polybutene additive obtained from Amoco Chemicals Company, Sample I. These oil samples were formulated to contain 4.7 wt% Acryloid-953 viscosity index improver obtained from Rohm and Haas, 2.5 wt% Mannich dispersant obtained from Amoco Chemicals Company, 1.25 wt% zinc dialkyldithiophosphate oxidant/wear inhibitor and 0.5 wt% high based sulfurized calcium phenate detergent obtained from Amoco Chemicals Company, and 89.95 wt% solvent-extracted Mid-Continent base stocks obtained from Amoco Oil Company.

In these dynamometer tests, a Buick with a V-6 engine was mounted on a mileage accumulation dynamometer. The car was run at 25 mph and 55 mph, while the fuel consumption of unleaded regular gasoline was carefully measured. The percent fuel economy improvement is measured against the non-molybdenum-containing oil. The results of these dynamometer tests are presented hereinbelow in Table VI.

TABLE VI

| DYNAMOMETER TESTING | | |
|---|---|---|
| Sample | H | I |
| % Mo (in finished oil) | 0.016 | 0.02 |
| % Fuel Economy Δ (55 mph) | +0.9 | +1.0 |
| % Fuel Economy Δ (25 mph) | +0.6 | +0.7 |

Both of the additives tested provided fuel economy.

As can be seen from the results of the tests discussed hereinabove, overbased molybdenum-alkaline earth metal sulfonates prepared by the process of the present invention provide good antioxidant performance, friction reduction abilities, and fuel economy.

What is claimed is:

1. A process for the manufacture of an overbased molybdenum-alkaline earth metal sulfonate, which process comprises: (a) introducing into a reaction zone a sulfonic acid, at least about 0.1 wt% of which is neutralized with ammonia; (b) adding a substantially inert diluent, an alkaline earth metal compound, an alkanol having from one to seven carbon atoms, and water to said reaction zone to form a hydration mixture; (c) heating said hydration mixture to an elevated temperature to hydrate said alkaline earth metal compound to produce an alkaline earth metal hydroxide hydrate; (d) adding an acidic material to said reaction zone at a temperature within the range of about 26.7° C. (80° F.) to about 68.5° C. (155° F.); and (e) adding a molybdenum-containing compound to said reaction zone at a time in said process that is subsequent to said introducing of a sulfonic acid and prior to said adding of an acidic material to form said molybdenum-alkaline earth metal sulfonate.

2. The process of claim 1 wherein said alkanol is stripped from contents in said reaction zone to provide a substantially alkanol-free composition.

3. The overbased molybdenum-alkaline earth metal sulfonate that is prepared by the process of claim 1.

4. The process of claim 1, wherein said sulfonic acid is selected from the group consisting of petroleum sulfonic acids, alkyl sulfonic acids, aryl sulfonic acids, alkenyl sulfonic acids, and alkyl aryl sulfonic acids.

5. The process of claim 2, wherein said molybdenum-containing compound is a member of the group consisting of ammonium molybdate, molybdenum oxides, molybdenum sulfides, Group I metal salts of molybdic acid, and Group II metal salts of molybdic acid and wherein said alkaline earth metal compound is a magnesium compound.

6. The process of claim 2, wherein a polybutene succinic anhydride or long chain carboxylic acid having a chain length of greater than 10 carbon atoms or long chain alcohol having greater than 10 carbon atoms is added to the reaction zone during said process.

7. The process of claim 2, wherein said diluent and said alkaline earth metal compound are added to said reaction zone prior to the addition of said alkanol and said water.

8. The process of claim 2, wherein said molybdenum-containing compound is added to said reaction zone subsequent to said stripping of said alkanol and prior to said adding of said acidic material.

9. The process of claim 2, wherein said molybdenum-containing compound is added to said reaction zone subsequent to said heating of said hydration mixture and prior to said stripping of said alkanol.

10. The process of claim 4, wherein said sulfonic acid is alkyl benzene sulfonic acid.

11. The process of claim 6, wherein said molybdenum-containing compound is a member of the group consisting of ammonium molybdate, molybdenum oxides, molybdenum sulfides, Group I metal salts of molybdic acid, and Group II metal salts of molybdic acid and said alkaline earth metal compound is a magnesium compound.

12. The process of claim 7, wherein said molybdenum-containing compound is added to said reaction zone prior to the addition of said diluent and said alkaline earth metal compound.

13. The process of claim 8, wherein a polybutene succinic anhydride is added as a process aid to the reaction zone during said process.

14. The process of claim 8, wherein said molybdenum-containing compound is a member of the group consisting of ammonium molybdate, molybdenum oxides, molybdenum sulfides, Group I metal salts of molybdic acid, and Group II metal salts of molybdic acid, said acidic material is a member selected from the group consisting of lower aliphatic carboxylic acids and inorganic acidic gases and liquids, said alkaline earth metal compound is a magnesium compound, said diluent comprises xylene, and said alkanol comprises methanol.

15. The process of claim 9, wherein a polybutene succinic anhydride is added as a process aid to the reaction zone during said process.

16. The process of claim 9, wherein said molybdenum-containing compound is a member of the group consisting of ammonium molybdate, molybdenum oxides, molybdenum sulfides, Group I metal salts of molybdic acid, and Group II metal salts of molybdic acid, said acidic material is a member selected from the group consisting of lower aliphatic carboxylic acids and inorganic acidic gases and liquids, said alkaline earth metal compound is a magnesium compound, said diluent comprises xylene, and said alkanol comprises methanol.

17. The process of claim 11, wherein said polybutene succinic anhydride is added to said reaction zone prior to the addition of said molybdenum-containing compound.

18. The process of claim 12, wherein a polybutene succinic anhydride is added as a process aid to the reaction zone during said process.

19. The process of claim 12, wherein said molybdenum-containing compound is a member of the group consisting of ammonium molybdate, molybdenum oxides, molybdenum sulfides, Group I metal salts of molybdic acid, and Group II metal salts of molybdic acid, said acidic material is a member selected from the group consisting of lower aliphatic carboxylic acids and inorganic acidic gases and liquids, said alkaline earth metal compound is a magnesium compound, said diluent comprises xylene, and said alkanol comprises methanol.

20. The process of claim 13, wherein said molybdenum-containing compound is a member of the group consisting of ammonium molybdate, molybdenum oxides, molybdenum sulfides, Group I metal salts of molybdic acid, Group II metal salts of molybdic acid, said hydration mixture contains said alkaline earth metal compound in an amount within the range of about 1 mole of alkaline earth metal compound per mole of sulfonic acid to about 20 moles of alkaline earth metal compound per mole of sulfonic acid, said diluent is present in an amount within the range of about 20 wt% to about 80 wt% of said hydration mixture, said alkanol is present in an amount within the range of about 1 mole of alkanol per mole of sulfonic acid to about 8 moles of alkanol per mole of sulfonic acid, said hydration mixture contains water in an amount within the range of about 1 mole of water per mole of alkaline earth metal compound to about 5 moles of water per mole of alkaline earth metal compound, said acidic material is a member selected from the group consisting of lower aliphatic carboxylic acids and inorganic acidic gases and liquids, and said diluent comprises mineral oil, xylene, toluene, 5W lubricating oil, naphtha, mixtures of mineral oil and xylene, mixtures of mineral oil and toluene, or mixtures of mineral oil and naphtha.

21. The overbased molybdenum-alkaline earth metal sulfonate that is prepared by the process of claim 14.

22. The process of claim 15, wherein said molybdenum-containing compound is a member of the group consisting of ammonium molybdate, molybdenum oxides, molybdenum sulfides, Group I metal salts of molybdic acid, Group II metal salts of molybdic acid, said hydration mixture contains said alkaline earth metal compound in an amount within the range of about 1 mole of alkaline earth metal compound per mole of sulfonic acid to about 20 moles of alkaline earth metal compound per mole of sulfonic acid, said diluent is present in an amount within the range of about 20 wt% to about 80 wt% of said hydration mixture, said alkanol is present in an amount within the range of about 1 mole of alkanol per mole of sulfonic acid to about 8 moles of alkanol per mole of sulfonic acid, said hydration mixture contains water in an amount within the range of about 1 mole of water per mole of alkaline earth metal compound to about 5 moles of water per mole of alkaline earth metal compound, said acidic material is a member selected from the group consisting of lower aliphatic carboxylic acids and inorganic acidic gases and liquids, and said diluent comprises mineral oil, xylene, toluene, 5W lubricating oil, naphtha, mixtures of mineral oil and xylene, mixtures of mineral oil and toluene, or mixtures of mineral oil and naphtha.

23. The overbased molybdenum-alkaline earth metal sulfonate that is prepared by the process of claim 16.

24. The process of claim 18, wherein said molybdenum-containing compound is a member of the group consisting of ammonium molybdate, molybdenum oxides, molybdenum sulfides, Group I metal salts of molybdic acid, Group II metal salts of molybdic acid, said hydration mixture contains said alkaline earth metal compound in an amount within the range of about 1 mole of alkaline earth metal compound per mole of sulfonic acid to about 20 moles of alkaline earth metal compound per mole of sulfonic acid, said diluent is present in an amount within the range of about 20 wt% to about 80 wt% of said hydration mixture, said alkanol is present in an amount within the range of about 1 mole of alkanol per mole of sulfonic acid to about 8 moles of alkanol per mole of sulfonic acid, said hydration mixture contains water in an amount within the range of about 1 mole of water per mole of alkaline earth metal compound to about 5 moles of water per mole of alkaline earth metal compound, said acidic material is a member selected from the group consisting of lower aliphatic carboxylic acids and inorganic acidic gases and liquids, and said diluent comprises mineral oil, xylene, toluene, 5W lubricating oil, naphtha, mixtures of mineral oil and xylene, mixtures of mineral oil and toluene, or mixtures of mineral oil and naphtha.

25. The overbased molybdenum-alkaline earth metal sulfonate that is prepared by the process of claim 19.

26. The process of claim 20, wherein said alkaline earth metal compound is a magnesium compound, said diluent comprises xylene, said alkanol comprises methanol, said acidic material is carbon dioxide, and said molybdenum-containing compound is molybdenum trioxide.

27. The process of claim 22, wherein said alkaline earth metal compound is a magnesium compound, said diluent comprises xylene, said alkanol comprises methanol, said acidic material is carbon dioxide, and said molybdenum-containing compound is molybdenum trioxide.

28. The process of claim 24, wherein said alkaline earth metal compound is a magnesium compound, said diluent comprises xylene, said alkanol comprises methanol, said acidic material is carbon dioxide, and said molybdenum-containing compound is molybdenum trioxide.

29. The process of claim 26, wherein said polybutene succinic anhydride is added to said reaction zone prior to the addition of said molybdenum-containing compound and wherein said diluent and said alkaline earth metal compound are added to said reaction zone prior to the addition of said alkanol and said water.

30. The process of claim 27, wherein said polybutene succinic anhydride is added to said reaction zone prior to the addition of said molybdenum-containing compound and wherein said diluent and said alkaline earth metal compound are added to said reaction zone prior to the addition of said alkanol and said water.

31. The process of claim 28, wherein said polybutene succinic anhydride is added to said reaction zone prior to the addition of said molybdenum-containing compound.

32. The overbased molybdenum-alkaline earth metal sulfonate that is prepared by the process of claim 29.

33. The overbased molybdenum-alkaline earth metal sulfonate that is prepared by the process of claim 30.

34. The overbased molybdenum-alkaline earth metal sulfonate that is prepared by the process of claim 31.

* * * * *